US005725154A

United States Patent [19]

Jackson

[11] Patent Number: 5,725,154

[45] Date of Patent: Mar. 10, 1998

[54] DENSE FLUID SPRAY CLEANING METHOD AND APPARATUS

[76] Inventor: David P. Jackson, 6098 Ruberta, Glendale, Calif. 91201

[21] Appl. No.: 516,530

[22] Filed: Aug. 18, 1995

[51] Int. Cl.[6] ..... B05B 1/24; B05B 15/00; B05B 7/10; B05B 7/12

[52] U.S. Cl. ..... 239/135; 239/289; 239/406; 239/417; 239/429; 239/525

[58] Field of Search ..... 239/135, 406, 239/420, 424, 424.5, 429, 430, 416, 417, 525, 390, 391, 289

[56] References Cited

U.S. PATENT DOCUMENTS

| | | | |
|---|---|---|---|
| 1,814,112 | 7/1931 | Beddoes | 239/390 |
| 2,083,851 | 6/1937 | Marcy | 239/429 |
| 2,919,071 | 12/1959 | Dalton | 239/525 |
| 3,131,868 | 5/1964 | Coleman | 239/391 |
| 3,199,600 | 8/1965 | Jacobs | 239/430 |
| 3,201,048 | 8/1965 | Gibbs | 239/430 |
| 3,398,609 | 8/1968 | Schott | 239/417 |
| 4,862,837 | 9/1989 | Holmes | 239/406 X |
| 5,344,493 | 9/1994 | Jackson . | |
| 5,368,171 | 11/1994 | Jackson . | |

FOREIGN PATENT DOCUMENTS

| | | | |
|---|---|---|---|
| 995656 | 6/1965 | Belgium | 239/417 |
| 1019396 | 6/1966 | France | 239/417 |

*Primary Examiner*—Andres Kashikow
*Assistant Examiner*—Robin O. Evans

[57] ABSTRACT

A spray gun for cleaning using a dense fluid such as $CO_2$, provides snow pellets of controllable size and kinetic energy, the kinetic energy being at a significantly higher level than has heretofore been attainable. A heated or thermal ionized gas is passed at substantial pressure accelerates the snow particles with an enveloping stream of gas. Charge build-up both within the snow delivery tube and in the substrate region is minimized by the use of a grounding helix in the snow delivery tube, in conjunction with the thermal ionized gas.

21 Claims, 8 Drawing Sheets

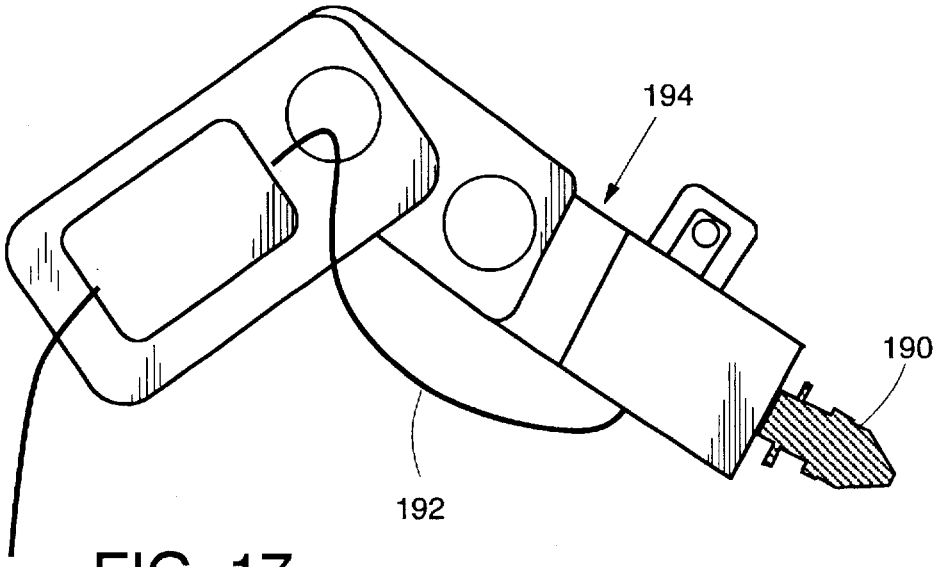
FIG. 17.
FIG. 18.
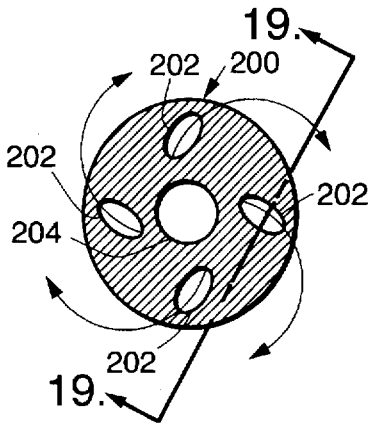
FIG. 19.
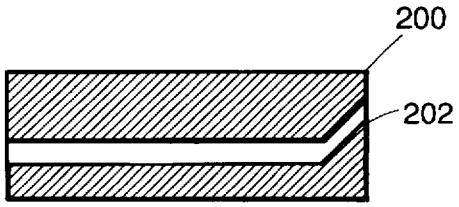

DENSE FLUID SPRAY CLEANING METHOD AND APPARATUS

FIELD OF THE INVENTION

This invention relates to dense fluid spray techniques for cleaning, and more particularly to hand-held, compact and maneuverable solid particle spray systems using dense fluids such as carbon dioxide.

BACKGROUND OF THE INVENTION

Cleaning techniques utilizing some phase of a dense fluid, such as carbon dioxide, air or nitrogen are in use because of the special capabilities of such materials for entraining and releasing contaminants. For example, carbon dioxide in liquid or supercritical phase acts as a solvent for contaminants such as oils and greases on surfaces, but when the phase is changed to the gaseous state, the contaminants precipitate or are carried away with the stream. The dense fluid approach provides an environmentally sound and particularly efficacious method of cleaning a variety of items including delicate surfaces, foods and machine parts.

One important variant is the use of a spray of solid particles of the dense fluid on a surface having adhering particulates. The kinetic energy alone can dislodge the particles, and the chemical and solvent properties assist in this cleaning, which is not injurious to the supporting substrate.

There are two principal types of dense fluid spraying devices. In a first, liquid dense fluid, such as $CO_2$, is supplied to a sprayer, usually a hand-held mechanism, where the liquid is converted to a gas in an expansion valve and expelled through the spray nozzle. In the rapid expansion, the gaseous $CO_2$ coalesces into solid particles and the stream impacts the substrate. The dual cleaning action that results from transfer of the kinetic energy to the particles, and the solvent action, loosens and dislodges the surface particulates. Though such devices can be fixed or hand-held, they are typically bulky and inconvenient to use as the entire device becomes cold, even after a short period of use. In addition, the snow precipitously drops the temperature of the surface to be cleaned (substrate), inhibits the cleaning action and tends to allow redeposition of the particulates. The dense fluid itself is the propellant and the velocity of the dense fluid as it is expelled from the nozzle is controllable only with pressure variations. In addition to the triboelectric effect, electrostatic charges build up on the surface which also promotes redeposition of particulates. Finally, it is desirable in many instances to vary the droplet size of the spray depending on the nature and size of the particulates on the substrate. This is not feasible, however, with sprayers which are currently available.

In a second type of $CO_2$ spray device, the liquid dense fluid is first converted to solid particulates, either in pellet form or by mechanically removing particles from a solid block. Using gas pressure, which can be at a high level and controlled, the "snow" is ejected through a nozzle onto the target area. These devices are bulkier than the first type mentioned, and therefore considerably more cumbersome and costly. In addition, they do not permit variation of the particle size and they have the disadvantage of cooling off the target area and generating electrostatic charges, as previously mentioned.

There is, therefore, a need for guns for spraying solid particles of a dense fluid material that are compact and readily manipulable, but permit adjustment of stream velocity and, particle size without adverse electrostatic charge build up. In addition, despite the small size, the device should be adaptable to different configurations and should be operable without becoming so cold as to make it difficult for the operator to use them. Such a device could then be used in a variety of contexts, controlled manually or by machine, and would be particularly effective for cleaning concave surfaces and crevices on complex surfaces.

SUMMARY OF THE INVENTION

In accordance with the invention, a dense fluid, in liquid form, is expanded at a spaced apart region from the point of delivery and passed along a delivery tube to a nozzle. The emitted, coalesced particles are accelerated by an encompassing stream of pressurized gas. This device and method enable kinetic energy and particle size to be optimized for a given situation.

Moreover, the length of the delivery tube is disposed within a triboelectric cage which provides a grounding structure, and the gas providing the propulsion effect is a thermal ionized gas that flows concentrically about the delivery tube. The snow gun includes a gap between the delivery tube and an encompassing gas flow path so that an ionized thermal stream of gas impels the dense fluid particles at higher velocity toward a substrate. The dual flow establishes a thermal gradient across the substrate, ranging from a higher temperature at the outer circumference to the coldest temperature along the central axis. Thus the mean temperature is defined as substantially constant in the target area as the snow gun is scanned across the surface of that area.

An exemplary system in accordance with the invention includes a base housing containing an expansion valve which receives liquid dense fluid at a selected temperature and pressure range. The expanding gas flows into an elongated delivery tube having a helical grounding wire forming a triboelectric cage, and encompassed by a wrapped insulative sheath. A thermal ionized gas flows in a concentric space defined between the sheath and an outer flexible tube. The delivery tube extends in the distal direction into a hand held gun structure, with the gas flowing about it into a gas flow gap leading to a nozzle mounted about the distal end of the body structure. The flowing thermal ionized gas greatly accelerates the particles, and its velocity and temperature both may be controlled as needed for the target surface.

In a system for using the device, a base unit includes an electrical connection, a liquid dense fluid source and a gas source, and a gas expansion valve. The base unit also includes means for heating and ionizing the gas, and valve controls for the dense fluid and gas, which may be remotely controlled from the handpiece. The valve controls for the dense fluid allow the dense fluid to be delivered in intermittent burst or as a continuous stream within the gas. A feature of the invention is that the unit may be made in a very compact pencil configuration and disposed at the end of a flexible supply line, the length and diameter of which can be selected to control particle size and density.

In another example of a device in accordance with the invention, the position of the distal end of the snow delivery tube may be made adjustable relative to the end nozzle, and both particle velocity and size may be varied by adjustments at the handgun. For this purpose, the handgun includes a gun base supporting an axially adjustable flow adjustment body which in turn receives a terminal thrust adjustment nozzle. The position of the flow adjustment body relative to the distal end of the snow delivery tube and the position of the thread adjustment nozzle relative to the flow adjustment body control particle size and velocity so that adjustment can be made to account for different substrate conditions.

In yet another configuration, a spray gun in accordance with the invention may be mounted on the end arm of a robot mechanism. A light beam, such as a laser beam serving as a pointer mounted on the robot arm may be angled toward a point of impact, and the automatic programming feature of a commercial robot mechanism may be used to select the scanning operation, so that items to be cleaned can be moved along a line and a complex pattern for exploring the interior of concavities may be followed by the robot mechanism.

BRIEF DESCRIPTION OF THE DRAWINGS

A better understanding of the invention may be had by reference to the following description, taken in conjunction with the accompanying claims, in which:

FIG. 17 is a simplified side view of a snow gun device in accordance with the invention mounted on a robot arm;

FIG. 18 is an end view of a vortex nozzle for use in the present invention; and

FIG. 19 is a cross-sectional view of FIG. 18 taken along lines 19—19.

DETAILED DESCRIPTION OF THE INVENTION

Figure 1:
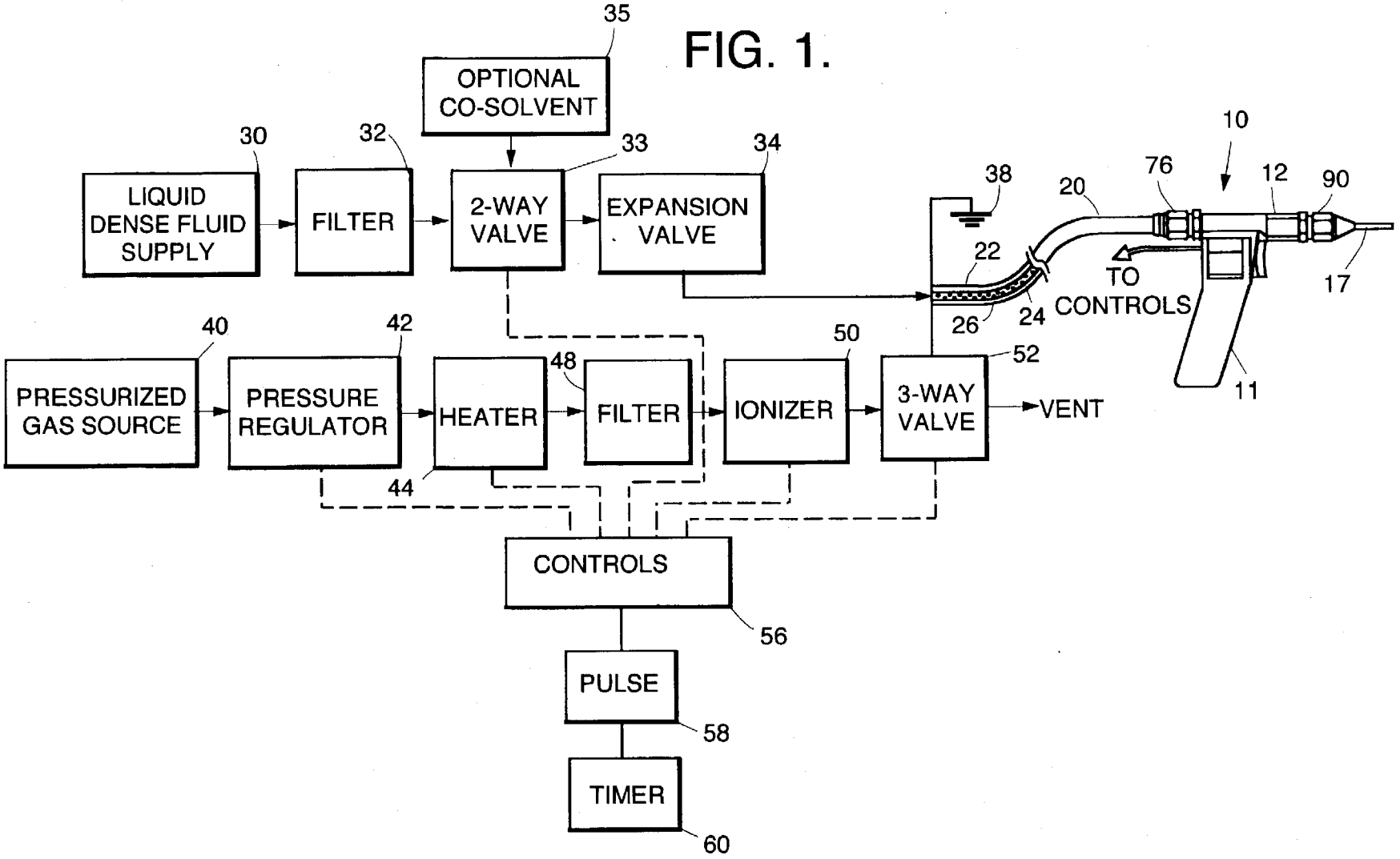
FIG. 1 is a combined block diagram and perspective view, partially broken away, of a system and a spray gun device in accordance with the invention.

A system for operating a dense fluid particle spraying device such as a spray gun 10 is shown in general form in FIG. 1. The spray gun 10 comprises a gun base or body 12 which leads to a small pencil type applicator or nozzle 90. At an end opposite the applicator is attached a composite supply line 20.

Figure 3:
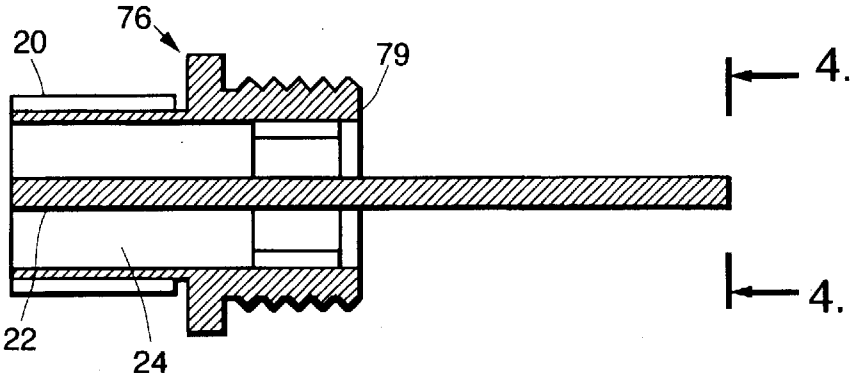
FIG. 3 is side sectional view of a threaded fitting.
Figure 5:
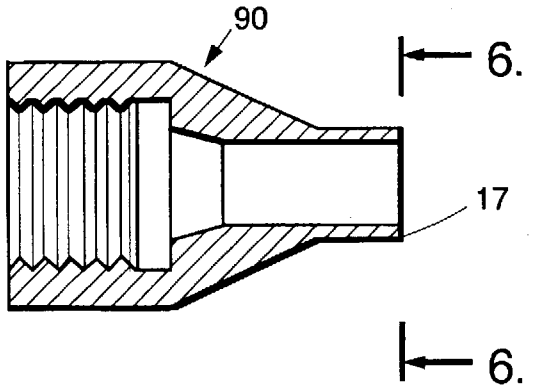
FIG. 5 is side sectional view of a nozzle.

The composite supply line comprises an outer flexible tube 23 containing a smaller and central snow delivery tube 22, the space between them defining a gas delivery gap 24 concentric with and outside the tube 22 (see FIG. 3). Thus, as dense fluid in gaseous phase is driven toward the spray gun 10 within the delivery tube 22, pressurized gas flows in gap 24 outside the snow delivery tube 22 to gun 10.

A grounding helix 26 of conductive wire forms a flexible triboelectric cage around the snow delivery tube 22 along the length of the composite supply line. The grounding helix 26 is covered and held in place by a sheath 28, such as a high thermal resistant, shrink wrapped plastic (see FIG. 7).

A supply 30 of dense fluid (e.g. $CO_2$ in the liquid phase) is passed through a filter 32 to remove any particulates. Flow is controlled by a valve 33, at which a co-solvent from a source 35 may be injected if desired for certain cleaning applications, as is known. The liquid dense fluid is then expanded to the gaseous phase in an expansion valve 34, and coupled into the interior of the snow delivery tube 22, along which it moves to the nozzle 90 at the distal end of the gun 10. Phase change of the dense fluid at a distance from the gun 10 is a departure from prior practice and is used here to advantage. Selection of delivery tube diameter and length determines both snow particle size, since particles build during transit, and velocity, since velocity decreases with transit.

Flow of dense fluid from the expansion valve to the nozzle is regulated by controller 56. The controller allows the dense fluid/particles to flow intermittently so that "puffs" of particles are delivered by the nozzle. When the flow of dense fluid/particles is interrupted, ionized hot gas continues to be delivered to the substrate. The rate at which the puffs of dense fluid/particles are delivered is variable so that on the one end of the range relatively long periods of ionized hot gas are delivered and only short bursts of dense fluid/particles while at the other end of the range the dense fluid/particles are delivered continuously in the stream of hot ionized gas. When only short puffs of the snow are delivered the ionized hot gas warms the substrate surface and inhibits cooling and condensation. The short pulses of snow are suitable for the use with delicate substrates which may be damaged by excessive cooling or to excessive exposure to the abrasive action of the snow. In other cases longer pulses or continuous delivery of snow are suitable for use with substrates which are resistant to cooling and to the abrasive action of the snow or which may be heavily contaminated. The rate of snow delivery can be varied to suit the need of a particular substrate to be cleaned.

The grounding helix 26 about the delivery tube 22 is coupled to an electrical ground 38, shown symbolically, and assures that charge build-up is dissipated along the length of the tube 22.

Concurrent with movement of the dense fluid, pressurized gas is supplied via the composite supply line 20 to gun 10, from a pressurized gas source 40, the actual pressure level being selectable at a regulator 42. The pressure of the gas is varied to deliver gas at a velocity of between 10 feet/minute (3 meters/minute) to 1,200 feet/minute (366 meters/minute).

The gas is converted to what is referred to herein as a "thermal ionized" state, by serial passage through a controllable heater 44, a filter 48, an ionizer 50 and three-way valve 52. Then, the thermal ionized gas is transferred into gap 24 for gas delivery to the gun, about the snow delivery tube 22. An alternate position of the three-way valve 52 is a venting position, for use in special operating or safety situations. The pressurized gas supply may supply nitrogen (preferably), air or some other suitable gas.

Controls for the different elements that are operable in the system are depicted generally in FIG. 1, since controls 56 may be on a control panel, at a foot control so that the hands can be left free, or can be separate manual controls at each of the different elements. Switches and dials at a control panel for basic non-changeable settings, and individual controls for thermal ionized gas, and snow at a foot switch will often be the preferred mode of operation, since this leaves the operator's hands free to manipulate the gun 10 itself.

A handle 11 may be permanently attached to the spray gun 10, or comprise a separate mechanism, similar to a pistol grip, for mounting the gun detachably so that it can be used either with or without the handle. In addition, controls may be placed on such a handle for convenient operation.

The controls 56 typically provide an adjustment for pressure, an adjustment for temperature level, an on/off control for the ionizer, and controls for the intermittent deliver of the dense fluid ($CO_2$) and on/off controls for the hot ionized gas. In accordance with the invention, it is also advantageous to have a pulsing control of $CO_2$ flow, so that valve 52 is turned off and on in a varying duty cycle fashion controlled by a pulser 58 and a settable timer 60. As will be described, this aids in certain cleaning operations.

The system of FIG. 1 provides versatility and advantages that have long been sought, but never before achieved. Expansion of the dense fluid at the proximal end of the flexible composite supply line 20 affords the advantage of enabling the spray gun to be compact and light weight, and in addition assures uniform distribution of fine particulates by the time gun 10 is reached. Very significantly, flow of the particulate is accelerated to a higher velocity by the encompassing thermal ionized gas because the encompassing gas flow both confines and imparts kinetic energy to the stream. The heated gas flowing around the snow delivery tube does not materially affect the pellets, but establishes a surface temperature that enables the operator to handle the device conveniently. While accelerating the particles the encompassing shield of thermal ionized gas also prevents charge build-up at the substrate, since imparting charges are equalized. The ability to manipulate the gun 10 freely, to provide different velocities is unique in this field and provides a far superior cleaning action.

Figure 2:
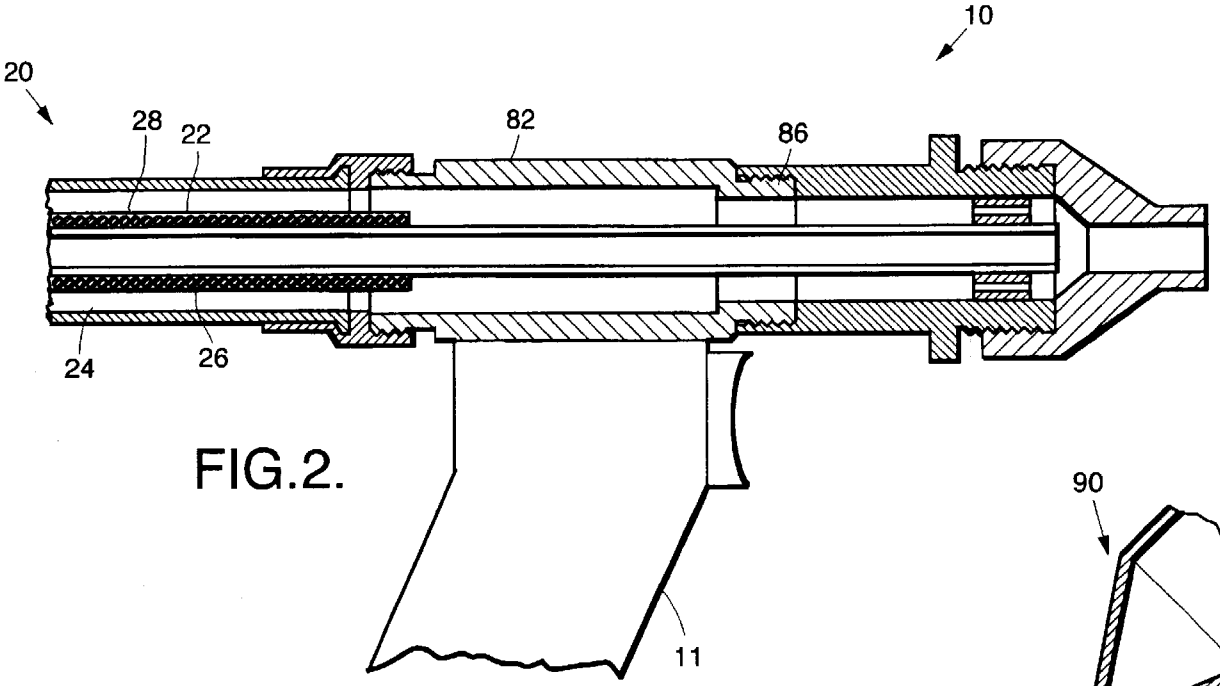
FIG. 2 is a side sectional view of the device of the present invention.

Referring now to FIG. 2, the composite supply line 20 aligns with the proximal end of the gun base 12, with the snow delivery tube 22 continuing beyond the end of the composite supply line and extending into the interior of gun 10, to a region adjacent the distal end of the gun. The diameter of the snow delivery tube is between 0.15" to 0.25" (0.4 to 6.35 mm). The amount of snow delivered by the snow delivery tube is dependent, in part, on the inner diameter of the snow tube, and also on the length, since particles accumulate and build during transit. The snow tube is one to four feet (0.3 to 1.2 m) in length in practical examples. Although snow particles build up as they travel along the length of tube, at the same time the velocity of the particles is reduced the longer the transit distance in tube 22. A snow delivery tube length of less than one foot (0.3 m) is undesirable since there is not sufficient snow at the delivery point (exit) while a snow delivery tube longer than four feet (1.2 m), is undesirable since the velocity of the snow at the exit is too slow. However, it should be noted that it is a fundamental aspect of the invention that relatively slow moving snow particles at the exit are then sped up by "momentum transfer" derived from the surrounding thermal ionized gas, as described in detail below. Another variable is thermal ionized gas pressure. At pressures in excess of 20 psi (1.4 atm) the velocity of the snow is accelerated to in excess of 1,000 feet per minute (305 m/min.).

Figure 4:
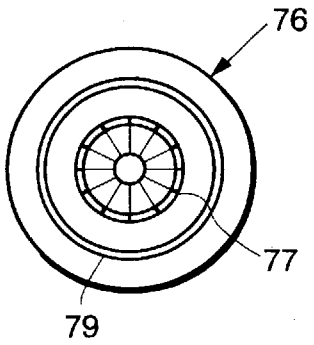
FIG. 4 is cross-sectional view of the threaded fitting of FIG. 3 taken along line 4—4.
Figure 6:
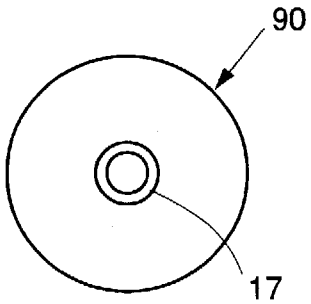
FIG. 6 is cross-sectional view of the nozzle of FIG. 5 taken along line 6—6.

A threaded fitting 76 is attached to the composite supply line, for connecting the composite supply line to the gun 10 (see FIGS. 3 and 4). Radial struts or separators 77 are included within the threaded fitting to maintain an adequately open axial passage, while at the same time providing the concentric spacing between snow delivery tube 22 and wall 79. Alternatively, parallel bores spaced circumferentially about the inner nozzle may be used to allow flow while providing structural support.

At the gun base is located a rotatable threaded connector 78 for connecting the composite supply hose to the gun. A circumferential gas passageway 84 is defined between a wall of the gun 82 and the snow delivery tube.

At the distal end of the gun, a threaded nozzle connector 86 threadably mounts the nozzle 90 onto the body of the gun 10.

The nozzle is interchangeable and nozzles with different internal diameters and different length can be used to suit the needs of substrate to be cleaned. The longer the extension at the end of the nozzle, the greater the velocity of the snow, which results from greater "momentum transfer" as the gas and snow particles pass along constricted exit tube 17. If the velocity is of the order of 1,000 feet per minute (305 m/min.), the transit time of the snow is too slow to allow significant thermal energy transfer between the snow particles and the thermal ionized gas. The present invention uses an unconventional nozzle length (constricted exit tube) of 0.5 feet (15 cm) to 6 feet (183 cm) and nozzle diameters of from 0.005 inches (0.13 mm) to 0.25 inches (6.35 mm). Snow generation is illustrated in Table I.

TABLE I

| Nozzle Diameter inches (mm) | Snow Production lbs/min (g/min) |
|---|---|
| 0.005 (0.13) | 0.258 (117) |
| 0.007 (0.18) | 0.360 (163) |
| 0.010 (0.25) | 0.516 (234) |
| 0.020 (0.51) | 1.032 (468) |
| 0.030 (0.76) | 1.236 (561) |
| 0.062 (1.57) | 3.198 (1,451) |

In a typical example of the operation of the system of FIGS. 1 and 2, liquid carbon dioxide is supplied in a selected pressure and temperature range, with typical values being from 300 psi (20 atm) at 0° F. (−18° C.) to 850 psi (58 atm) at 70° F. (21° C.) from the supply 30. The liquid is filtered through filter 32, passes through an open valve 33, is expanded to the gaseous state by the expansion valve 34 and coupled into the snow delivery tube at a point spaced apart from the spray gun 10. The passage along the length of the snow delivery tube 22 allows small solid $CO_2$ particulates to coalesce and become uniformly distributed within the tube.

During passage along tube 22, however, triboelectric effects induce electrostatic charges that would, if not dispersed, have potentially adverse affects both on snow delivery and on the target substrate. In the present example, excess electrostatic charges are dissipated by flexible grounding helix 26 that extends the length of the delivery line up to the proximal end of spray gun 10.

Figure 7:
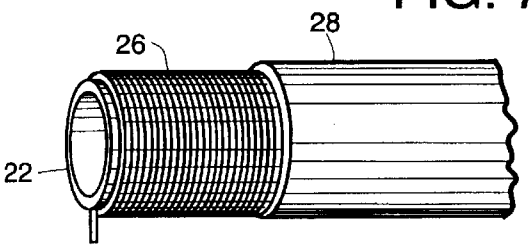
FIG. 7 is a fragmentary perspective view, partially broken away, of a delivery tube having a triboelectric cage thereon.

The system concurrently delivers a flow of heated ionized gas at a pressure determined by regulator 42 and a temperature determined by heater 44, both of which settings may be selectively controlled. After passing through the ionizer 50, the heated ionized gas is delivered from the three-way valve to gas delivery gap 24 between outer tube 23 and sheath 28 of the inner part of composite supply tube 20. The sheath also serves as thermal insulation between snow delivery tube 22 and the ionized gas. As seen in FIG. 7, adequate grounding is provided, while the composite supply line 20 is adequately flexible for manual handling, because the grounding helix 26 can be of a small diameter winding with a pitch small enough to provide closely spaced turns along the length of tube 22.

Figure 8:
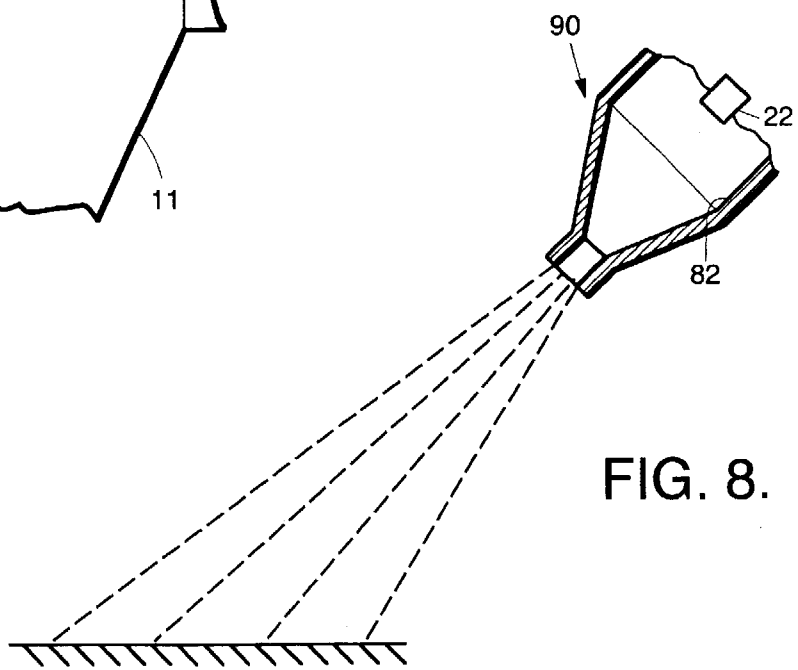
FIG. 8 is a diagrammatic illustration of the manner in which a snow spray and an encompassing flow of thermal ionized gas impact on a substrate.

The thermal ionized gas coaction increases kinetic energy significantly by encompassing the pellet stream and interacting at the interface region to significantly accelerate its flow rate. Since kinetic energy varies as the square of the velocity, the impact forces are thus exponentially increased. As seen in somewhat simplified form in FIG. 8, however, the action of increasing the velocity does not require a strong mixing of the thermal ionized gas with the snow pellets, which are effectively accelerated with the surrounding gas in the short space before impacting the target.

It should be recognized that if desirable, a co-solvent or cleaning aid can be used in conjunction with the solid phase carbon dioxide. In a number of instances, for example, it is desired to emphasize particle cleaning characteristics, including improving the solvent action, providing a bactericidal capability, enhancing electrostatic dissipation properties or improving abrasiveness of the cleaning spray. It is known to use co-solvents, such as alcohols, esters and ketones to modify cleaning characteristics, and these may or may not include surfactants for improving wetting and dispersion capabilities. Also, microsphere abrasives such as silica can be added to the cleaning spray. The ionized gas stream also permits the introduction of solid particulates, such as silica particles, which can be particularly effective in removal of gross contaminants such as gummy residues. Co-solvents can be introduced into the liquid dense fluid just prior to expansion, or disbursed into the solid phase following expansion.

Figure 10:
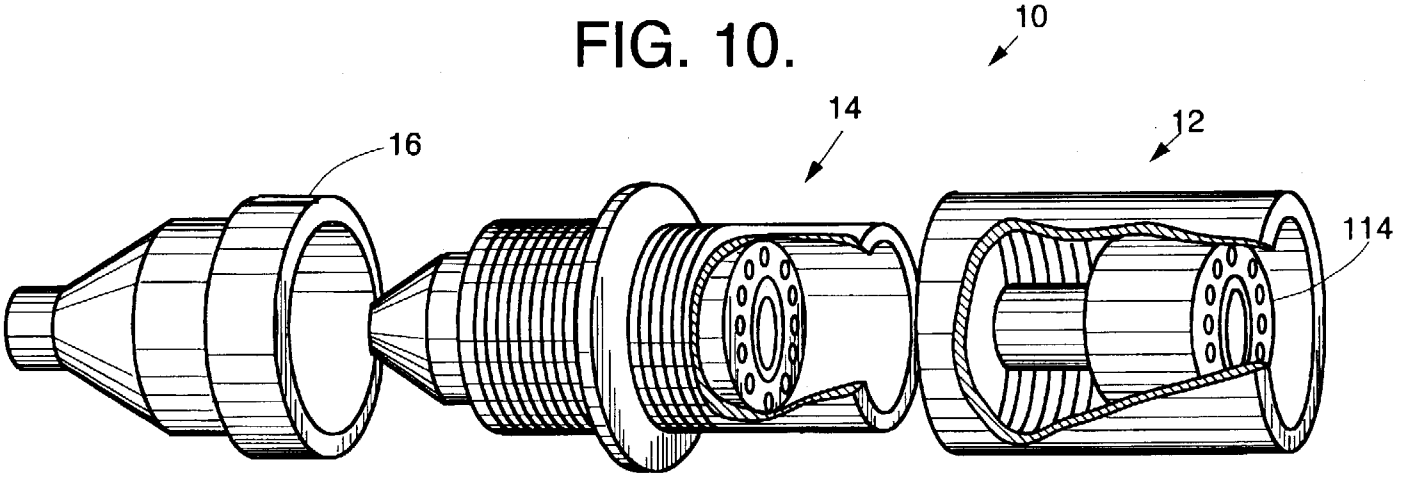
FIG. 10 is an exploded sectional view of an adjustable device in accordance with the invention.
Figure 11:
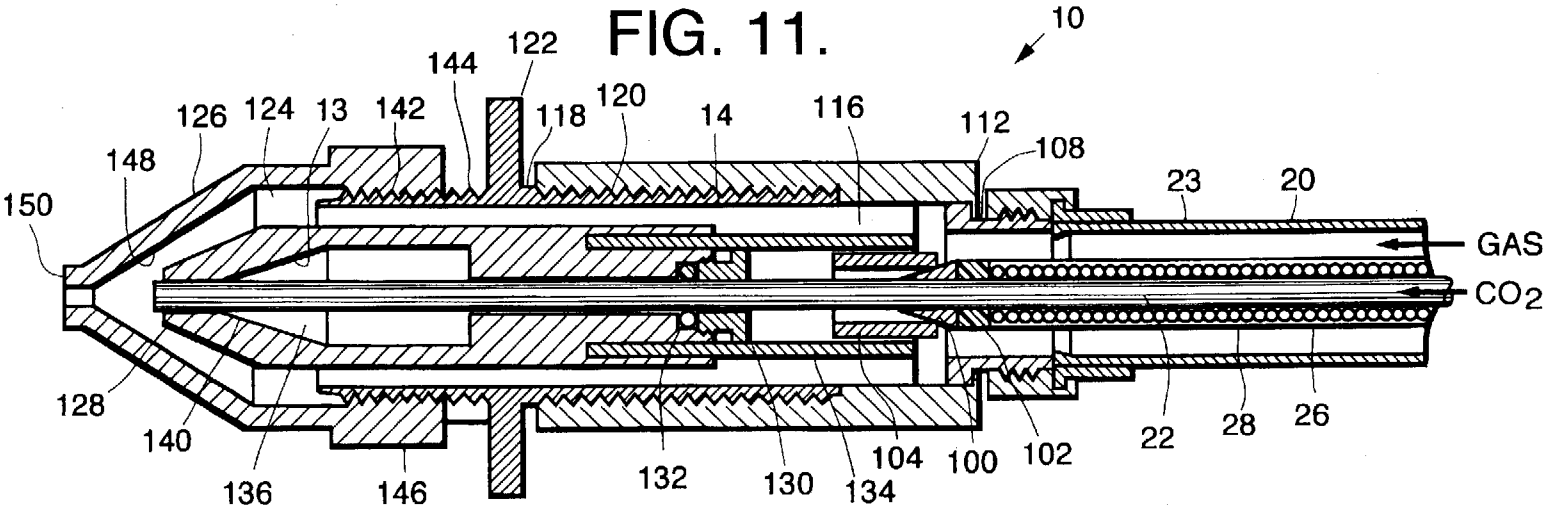
FIG. 11 is a side sectional view of the device of FIG. 10.

Another example of a dense fluid particle spraying device in accordance with the invention is shown in FIGS. 10 and 11. This spray gun is similar to that of FIG. 2, and the same numbers are used for similar parts. The spray gun 10 comprises a gun base or body 12 to which is coupled a flow adjustment body 14 leading to a thrust adjustment nozzle 16. The flow adjustment body 14 is axially movable relative to the end of a composite supply line 20. The position of the flow adjustment body 14 relative to the distal end of the snow delivery tube 22 determines the particle size of "snow" expelled through thrust adjustment nozzle 16. At the same time, the axial position of the thrust adjustment nozzle 16 relative to the distal end of the flow adjustment body 14 predetermines, in conjunction with the gas pressure, the velocity imparted to the particles.

The particle size can be adjusted to provide pellets that are best adapted to clean a particular substrate. Very significantly, flow of the particulate is accelerated to a velocity by the encompassing thermal ionized gas that greatly facilitates the cleaning action. The ability to manipulate the gun 10 freely, to provide different types of sprays and different velocities is unique in this field and provides a far superior cleaning action.

The construction of spray gun 10 allows adjustment both of $CO_2$ particulate size and thrust. The composite supply line 20 fits in to the proximal end of gun base 12, with the snow delivery tube 22 extending into the interior of the flow adjustment body 14, to the region of its distal end. The grounding helix 26 and its protective sheath 28 terminate at the proximal end of gun base 12, and a conical gasket 100 on snow delivery tube 22 is held against movement in the proximal direction by a retainer ring 102. Conical gasket 100 wedges into a compression ferrule 104 held in an inner base portion 106 having an outer diameter with threads that match threads 108 on gun base 12. The inner base 106 includes a receiver flange 110 with an outer diameter 112 and an inner diameter 114 that are separated by a gas passage 116 that provides gas flow along the axis of spray gun 10 toward the distal end. The outer tube 23 of the composite supply line 20 fits in a mating relation over the outer diameter 112, while sheath 28 about snow delivery tube 22 fits within inner diameter 114. Thus, the gas delivery gap 24 is in communication with the gas passage 116, while the central bore of snow delivery tube 22 lies directly about the central axis of gun 10.

The flow adjustment body 14 has threads 118 mating with the threads 120 on gun base 12, for axial adjustment of the flow adjustment body at one end, and for receiving thrust adjustment nozzle 16 at the other end. A spray guard 122 intermediate these two, the two end threaded sections, limits backward deflection of spray of a substrate during use. A circumferential gas passageway 124 is defined between an outer sleeve 126 and an inner nozzle body 128 in flow adjustment body 14. The gas passageway is not fully circumferential, but includes radial struts or separators (not shown) to maintain an adequately open axial passage, while at the same time providing the concentric spacing between the outer sleeve 126 and inner nozzle body 128. Alternatively, this gas passageway, in alignment with gas passage 116 in gun base 12, may comprise a number of parallel bores spaced circumferentially about the flow adjustment body 14. In inner nozzle body 128, a recess 130 at the proximal end receives an O-ring 132 held in place against axial movement by retainer ring 134, the O-ring serving to retain snow delivery tube 22 in position despite axial movement of body 14 relative to tube 22, while also sealing against movement of $CO_2$ in the proximal direction, and mixing of gas with the $CO_2$.

At the distal end of inner nozzle body 128, the central bore in the body that receives snow delivery tube 22 opens into a larger diameter chamber 136 having walls 13 converging to an inner nozzle 140. With the adjustments possible, the distal end of the snow delivery tube can be within the chamber 136 or distally shifted to protrude from the inner nozzle 140, as seen in FIG. 10.

The thrust adjustment nozzle 16 has an annular body at its proximal end, with interior threads 142 mating with the exterior threads 144 on the flow adjustment body 14, and an outer ring 146 which can be knurled, to allow turning of the nozzle 16 for axial adjustment. Converging walls 148 concentric with the central axis lead to an outer nozzle 150 at the distal end. The converging walls 148 of thrust adjustment nozzle 16 are at a slightly greater angle than the converging outer walls 150 of inner nozzle 140, so as to accelerate gas flow moving toward outer nozzle 150.

Figures 9A, 9B, 9C:
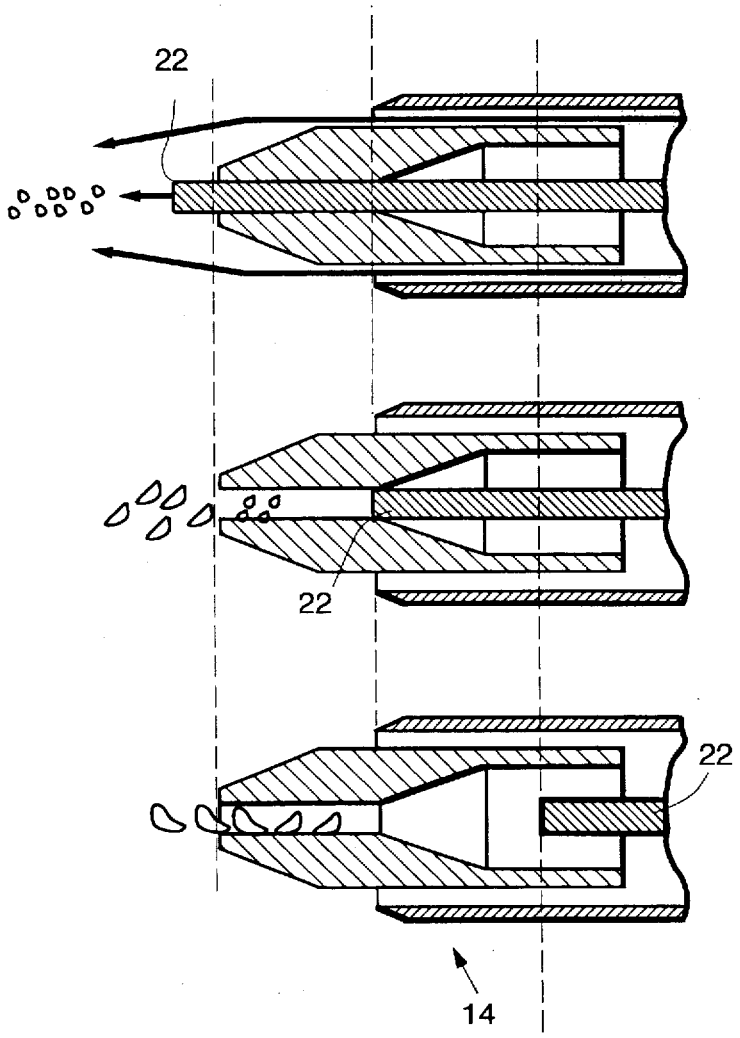
FIG. 9 comprising successive views 9A, 9B and 9C, shows variations of particle sizes with variations of snow delivery tube position.

In use, it should be appreciated that the axial position of flow adjustment body 14 relative to the distal end of the snow delivery tube 22 enables selection of particle size. As seen in FIG. 9A, if the distal end of the snow delivery tube 22 protrudes through the inner nozzle 140, then small particle size build up during passage along the snow delivery tube is maintained. If, however, tube 22 is within nozzle 140, particle size builds up to a medium size as seen as FIG. 9B. For largest particle size, the flow adjustment nozzle position is extended distally, seen in FIG. 9C so that emission of fine particles within chamber 136 allows expansion of the $CO_2$ and the coalescence of the particles to a maximum degree.

With particle size thus established in a selectable fashion, the thermal ionized gas coaction enables kinetic energy to be very significantly increased as well, as described above.

Another alternative that can be employed with the device of the present invention is to utilize the gas passageway as a vacuum line, withdrawing matter from a target surface or using the vacuum to clean the interior of the unit. The vacuum action is particularly suitable, since the device is capable of usage in a variety of micro environments in different ways. In some situations, it is advantageous to clean off some types of loose or redeposited particulates with a vacuum, and this can be done conveniently with the present system.

A remote control arrangement of the present invention, not shown, may use a foot pedal mechanism having separate controls for thermal ionized gas and snow in combination, and separate controls for thermal ionized gas and snow separately. For this purpose, the composite supply line 20 leads to a controller box via electrical lines at which the valves for coupling to the gas and $CO_2$ supplies are operated by switches on the face of the console.

Figure 12:
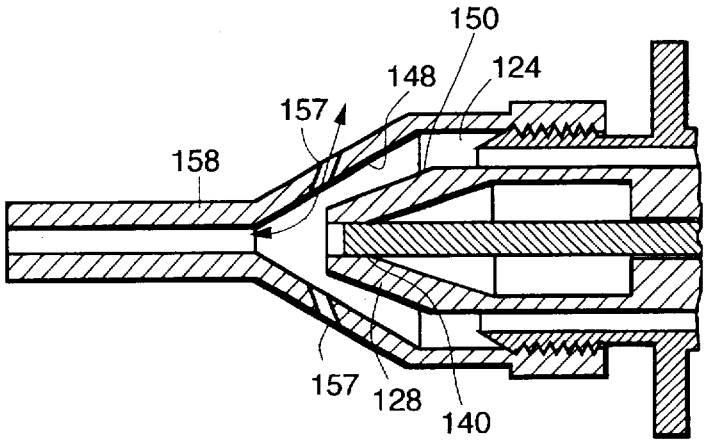
FIG. 12 is a side perspective view of a variation of a nozzle having side eductors.

A useful variant of the spray gun 10 of FIG. 1 is shown in FIG. 12, in which side mounted eductors 157 extending through the converging walls 148 before outer nozzle 150 are incorporated, and the nozzle tip itself is configured as an extended tubular element 158. This arrangement is particularly useful where the work involves a short confined spray path from the nozzle tip to the substrate, with the possibility of the nozzle tip coming too close to the substrate or actually contacting it to close off the nozzle opening. If this happens, the side eductors permit flow radially outwardly from the converging walls 148, preventing a significant back spray.

Figure 13:
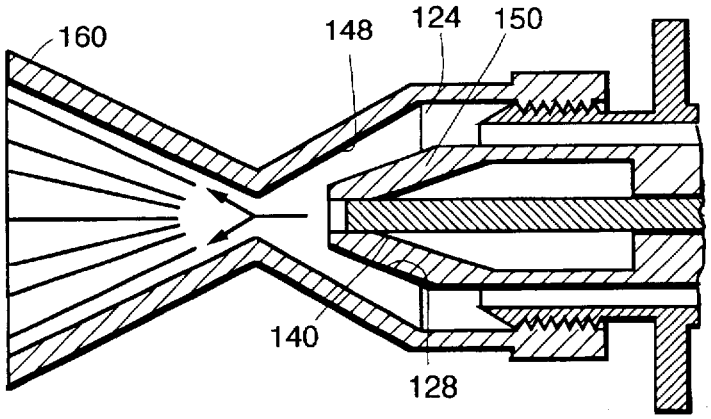
FIG. 13 is a side sectional view of a different nozzle variation having a fan-shaped nozzle exit.
Figure 14:
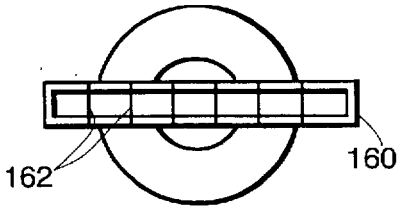
FIG. 14 is an end view of the fan nozzle of FIG. 13.

In other situations, it is useful to have a sheet or fan type of spray, and for these purposes, the arrangement of FIGS. 13 and 14 is useful. Here, the outer nozzle terminates in a fan configuration 160, with internal thin guides 162 arranged in a diverging pattern. Thus, where suitable for a particular cleaning application, an area can be covered with a sweeping action.

Figure 15:
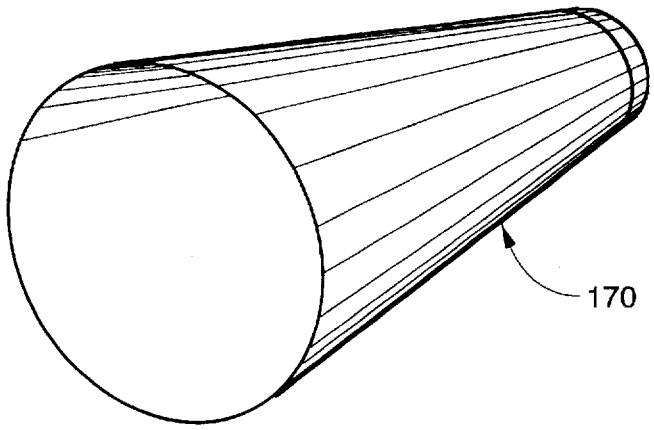
FIG. 15 is a perspective view of a cone attachment for use in the present invention.
Figure 16:
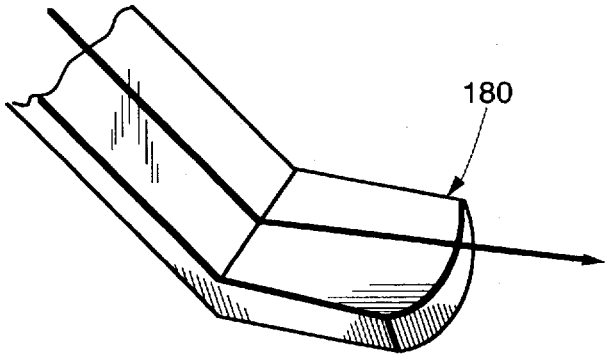
FIG. 16 is a perspective view of a deflector for use in the present invention.

In yet other situations, it is useful to use a cone attachment (see FIG. 15). The cone attachment 170 is useful with delicate substrate which may be pitted by high velocity snow. The cone slows the velocity of snow. Another attachment is a deflector 180 (see FIG. 16) which directs the snow at an angle to the nozzle. This allows the snow to be directed around corners and into places which would otherwise be difficult to access.

In other situations it is useful to mount tools on the end of the nozzle. Such tools include micro picks, scrapers and the like. The tools are attached to the end of the nozzle and assist the operator to clean using alternatively the tools and the snow gun, without having to continually put down and pick up the required utensils.

A spray gun 190 in accordance with the invention can be fed remotely by flexible lines 192, and are suitable for mounting, as shown in FIG. 17, on the end of a robotic mechanism 194, such as a micro-robot system sold under the trademark "MOVE MASTER RV-M1" by Mitsubishi Corporation. This system has a robot arm, a drive unit and a "teaching box". The arrangement allows the robot to be positioned in three dimension at selectable points relative to a work piece, so that the necessary commands can be entered and the routine can be repeated automatically. For purposes of usage in the teaching mode, a small laser is mounted on the end arm of the robot, adjacent the gun, and pointed at an angle and in a direction to intersect a work piece at a chosen distance. Thus, the operator need only control the working end of the robot arm to point the laser light at the selected target area, and enter these commands in the system. This enables the operator to select different angles of attack, so that the gun nozzle may be pointed into a concave surface, for example, in different directions to assure full cleaning.

In another embodiment of the present invention a "vortex nozzle tip" (see FIGS. 18 and 19) is used on the snow gun to counteract diffusion of the spray. The vortex nozzle 200 concentrates the "snow" delivered by the nozzle of the snow gun. Right-angled eductors 202 cause the thermal ionized gas to swirl around the dense fluid snow delivered by snow tube 204. The action of the swirling thermal ionized gas narrows the dense fluid snow stream. As a result the momentum of the thermal ionized gas\dense fluid snow delivered by the vortex nozzle is increased and allows the nozzle to placed at a greater distance from the substrate to be cleaned.

While there have been described above and illustrated in the drawings various forms and modifications in accordance with the invention, it will be appreciated that the invention is not limited thereto, but incorporates all variants and expedients within the scope of the appended claims.

What is claimed is:

1. A spray gun for spraying a particulate of a dense fluid comprising:

a spray gun body having a central bore from a proximal to a distal end along a central axis, and including a gas passageway radially spaced from the central bore;

a nozzle coupled to the distal end of the spray gun body, the nozzle having converging walls and a distal end orifice;

a snow delivery tube mounted within the central bore of the spray gun body;

a grounding helix about the snow delivery tube;

means for supplying a heated ionized gas to the gas passageway; and means for supplying an expanded dense fluid particulate stream through the snow delivery tube.

2. The spray gun as set forth in claim 1, further comprising a handle detachably mounted to the spray gun body.

3. The spray gun as set forth in claim 2, further comprising a remote control means for controlling the supply of dense fluid and gas to the spray gun body.

4. The spray gun as set forth in claim 1, wherein the snow delivery tube is one to four feet in length.

5. The spray gun as set forth in claim 1, wherein the snow delivery tube is 0.015 to 0.25 inches in diameter.

6. The spray gun as set forth in claim 1, further comprising a constricted exit tube disposed between the converging walls and a distal end orifice of the nozzle.

7. The spray gun as set forth in claim 6, wherein the constricted exit tube is 0.5 to 6 feet in length.

8. The spray gun as set forth in claim 1, further comprising a cone attachment for attachment to the nozzle.

9. The spray gun as set forth in claim 1, further comprising a deflector attachment for attachment to the nozzle.

10. The spray gun as set forth in claim 1, further comprising tool attachments for attachment to the nozzle.

11. The spray gun as set forth in claim 1, further comprising a vortex nozzle.

12. The spray gun as set forth in claim 1, wherein the means for supplying the expanded dense fluid is adjustable to supply snow in pulses.

13. A spray gun for dense fluids to provide control of both particle size and particle velocity, comprising:

a base member;

a snow delivery tube mounted in the base member, extending along a central axis and terminating at its distal end in an opening;

a flow adjustment body mounted in the base member and axially movable along the central axis with respect thereto, the flow adjustment body including a central bore concentric with the central axis and an interior chamber leading to a distal end, inner nozzle;

a thrust adjustment nozzle coupled to the flow adjustment body and axially movable therealong, the thrust adjustment nozzle including distal means defining an outer nozzle therefor;

the flow adjustment body including means for providing a gas passageway about the snow delivery tube;

means for supplying gas to the gas passageway; and means for supplying dense fluid particles to the snow delivery tube.

14. The spray gun as set forth in claim 13, wherein the base member and flow adjustment body include mating threaded surfaces, and wherein the flow adjustment body and thrust adjustment nozzle include mating threaded surfaces, for axial adjustments relative to each other in the base member.

15. The spray gun as set forth in claim 13, wherein the interior chamber in the inner body comprises means defining an interior chamber larger than the central bore, walls converging in the distal direction and leading to the snow delivery tube and wherein the base member includes means for receiving the means for supplying gas and the means for supplying dense fluid particles.

16. The spray gun as set forth in claim 13, wherein the flow adjustment body includes radial spray guard means, and a seal means including O-ring, coupled to the inner member of the flow adjustment body.

17. A delivery system for use with a spray gun for particles of a dense fluid comprising;

a composite supply tube having an outer wall and an interior snow delivery tube spaced apart from the outer wall to provide a gas delivery gap therebetween, the snow delivery tube including a central tube, a grounding helix about the central tube and a protective sheath about the grounding helix;

a spray gun having a central axis along which the snow delivery tube extends and having a distal end nozzle; and means coupled to the gas delivery gap for flowing an encompassing flow of accelerating gas about snow particles delivered from the distal end of the snow delivery tube.

18. The delivery system as set forth in claim 17, wherein the device further includes means for adjusting the position of the outer nozzle relative to the open end of the snow delivery tube.

19. The delivery system as set forth in claim 18, wherein the device further includes means defining an interior nozzle spaced apart from the outer nozzle, and means for adjusting the position of the inner nozzle relative to the distal end of the snow delivery tube.

20. A spray gun nozzle configuration for delivery of solid particulates of a dense fluid, comprising:

a snow delivery tube disposed along a central axis of the spray gun nozzle and having an open end;

an inner nozzle disposed adjacent to the open end of the snow delivery tube, and converging to an inner nozzle opening; and an outer nozzle disposed about the inner nozzle and spaced apart therefrom, the outer nozzle having a nozzle orifice substantially concentric with the central axis wherein the outer nozzle has a diverging terminating portion in one dimension and a substantially uniform opening in the orthogonal dimension.

21. A spray gun nozzle configuration for delivery of solid particulates of a dense fluid, comprising:

a snow delivery tube disposed along a central axis of the spray gun nozzle and having an open end;

an inner nozzle disposed adjacent to the open end of the snow delivery tube, and converging to an inner nozzle opening wherein the inner nozzle has an outer surface that converges at a selected angle relative to the central axis and the outer nozzle has an inner converging wall surface that converges at a greater angle to the central axis than the outer surface of the inner nozzle; and an outer nozzle disposed about the inner nozzle and spaced apart therefrom, the outer nozzle having a nozzle orifice substantially concentric with the central axis wherein the converging wall of the outer nozzle includes radial eductor apertures therein, and wherein the nozzle terminates at its orifice end in an extended tube.

* * * * *